US005092467A

United States Patent [19]

Elward

[11] Patent Number: 5,092,467

[45] Date of Patent: Mar. 3, 1992

[54] SHIPPING AND DISPLAY CONTAINER

[75] Inventor: John Elward, Novato, Calif.

[73] Assignee: The Clorox Company, Oakland, Calif.

[21] Appl. No.: 544,020

[22] Filed: Jun. 25, 1990

Related U.S. Application Data

[63] Continuation of Ser. No. 316,418, Feb. 27, 1989, abandoned.

[51] Int. Cl.[5] ..... B65D 73/00

[52] U.S. Cl. ..... 206/491; 229/40

[58] Field of Search ..... 229/40; 206/491, 45.14

[56] References Cited

U.S. PATENT DOCUMENTS

| | | | |
|---|---|---|---|
| 2,713,451 | 7/1955 | Williamson et al. | 229/40 |
| 3,137,435 | 6/1964 | Meyers | 229/40 |
| 3,156,377 | 11/1964 | Wysocki | 229/40 X |
| 3,157,309 | 11/1964 | Chidsey, Jr. et al. | 229/40 X |
| 3,167,214 | 1/1965 | Mahon | 206/491 X |
| 3,389,645 | 6/1968 | Winters et al. | 93/44 |
| 3,439,589 | 4/1969 | Geisler et al. | 93/52 |
| 3,454,212 | 7/1969 | Elward | 229/51 |
| 3,604,614 | 9/1971 | Sternfeld | 229/40 |
| 3,627,541 | 12/1971 | Farguhar | 99/171 R |
| 3,679,122 | 7/1972 | Neff | 229/40 |
| 3,680,691 | 8/1972 | Lock | 206/65 R |
| 3,705,681 | 12/1972 | Rossi et al. | 229/40 |
| 3,828,926 | 8/1974 | Rossi | 206/427 |
| 3,923,236 | 12/1975 | Calvert | 229/40 |
| 3,987,893 | 10/1976 | Hanson | 206/45.14 |
| 4,096,985 | 6/1978 | Wood | 229/40 |
| 4,105,152 | 8/1978 | Elward | 229/23 BT |
| 4,328,891 | 5/1982 | Elward | 206/158 |
| 4,362,240 | 12/1982 | Elward | 206/188 |
| 4,451,001 | 5/1984 | Webinger | 229/40 |
| 4,452,355 | 6/1984 | Benham | 206/45.14 |
| 4,582,199 | 4/1986 | Schuster | 229/40 |
| 4,732,316 | 3/1988 | Oliff et al. | 229/40 |

FOREIGN PATENT DOCUMENTS

| | | | |
|---|---|---|---|
| 2124590 | 2/1984 | United Kingdom | 206/45.14 |

*Primary Examiner*—William I. Price

*Attorney, Agent, or Firm*—Warren J. Krauss

[57] ABSTRACT

A container for shipping and displaying an individually packaged food comestible. It includes retainers which permanently retain the package when the container is closed. The container is created from a unitary sheet blank produced by the single strike of a die. The blank includes bottom, top and side panels demarcated by longitudinal and transverse fold lines. Two parallel transverse fold lines define matched side flaps on each side panel and retainer tabs on the bottom panel. Oblique fold lines, at angles of less than 90° with respect to the transverse fold lines, form four side sections disposed between each side flap and its corresponding retainer tab. In manufacturing the container, from the blank, each pair of side flaps and retainer tab are folded, along respective transverse fold lines, into contact with the corresponding side panels and bottom panel. Each side flap is securely held, relative to its respective side panel. When a package is placed within the confines of the bottom panel, and the panels are folded along the longitudinal fold lines, the act of folding causes the retainer tabs to lift away from the bottom panel and into a compressed uplifted position which firmly retains the package.

5 Claims, 4 Drawing Sheets

SHIPPING AND DISPLAY CONTAINER

This is a continuation of copending application Ser. No. 07/316,418 filed on Feb. 27, 1989 and now abandoned.

BACKGROUND OF THE INVENTION

This invention relates to a container and to a method of making a container for retaining a comestible package for shipping and display purposes. The container is made from a unitary blank of flexible sheet material which may be formed the single strike of an appropriate cutting and forming die. By the simple expedient of folding and holding in place oppositely disposed side flaps on the blank, one automatically produces effective retaining means for engaging and retaining in place the packed comestible.

A simple and economically fabricated, one piece, container for shipping and displaying a shaped comestible package has been long sought. In the past, such containers were often made from a plurality of pieces of stock material folded or pieced together in complicated arrangements, increasing the cost of production thereof.

The present invention utilizes a single piece of sheet stock material which, after cutting and forming, requires only a single manufacturing step to provide a reliable retainer means for engagement with the packed comestible in use. All of the fold lines and the blank itself can be produced by the single strike of an appropriate cutting and forming die.

SUMMARY AND OBJECTS OF THE INVENTION

The instant shipping and display container comprises a blank made of a unitary piece of foldable sheet material formed by a single strike of an appropriate die. The blank has suitable side, top, and bottom panels delineated with respect to one another by longitudinally disposed fold lines.

The side panels and bottom panel are separated from respective side flaps and retainer tabs by transverse fold lines. Between the side flaps and retainer tabs are disposed side sections which, along with the retainer tabs, are appropriately cut to form a surface for engaging a correspondingly shaped surface of a comestible package when the package is held within the container.

The retainer tabs are formed by the simple act of folding the side panels with respect to the bottom panel. In preparation for this step, the retainer tabs are readied for movement into a raised operative configuration by the folding and holding down, as by mechanical means, glue, or similar holding means, of the side flaps upon their respective side panels. With the side flaps thus held fixedly with respect to the side panels, transverse movement of the side flaps with respect to the side panels is prevented. As a result, folding of the side panels with respect to the bottom panel, along the longitudinal fold lines, creates a compression of the material forming the retainer tabs and associated side sections, forcing the retainer tabs to raise upwardly away from the bottom panel.

The retainer tabs are urged into an operative configuration by means of oblique fold lines which respectively separate each side flap from its adjacent side section and each side section from its adjacent retainer tab. There are four oblique fold lines for each of the two retainer tabs. The angles between each oblique fold line and the transverse fold lines for the side panels are less than 90°.

The primary object of the present invention is to provide a shipping and display container which is simple in design, while strong and effective in retaining a packed comestible for display and shipping purposes.

Another object of the present invention is to provide a shipping and display container made from a single piece of foldable sheet stock fabricatable by means of a single strike from an appropriate cutting and scoring die.

A further object of the present invention is to provide a sheet stock blank which, by means of a single fold and holding operation, can assume a three dimensional shape which retains a packed comestible in place.

Other objects and advantages of the present invention will become apparent from the following drawings and descriptions.

The accompanying drawings show, by way of illustration, the preferred embodiments of the present invention and the principles thereof. It should be recognized that other embodiments of the invention, applying the same or equivalent principles, may be used and that structural changes may be made as desired by those skilled in the art without departing from the spirit of the invention.

DETAILED DESCRIPTION

Figure 1:
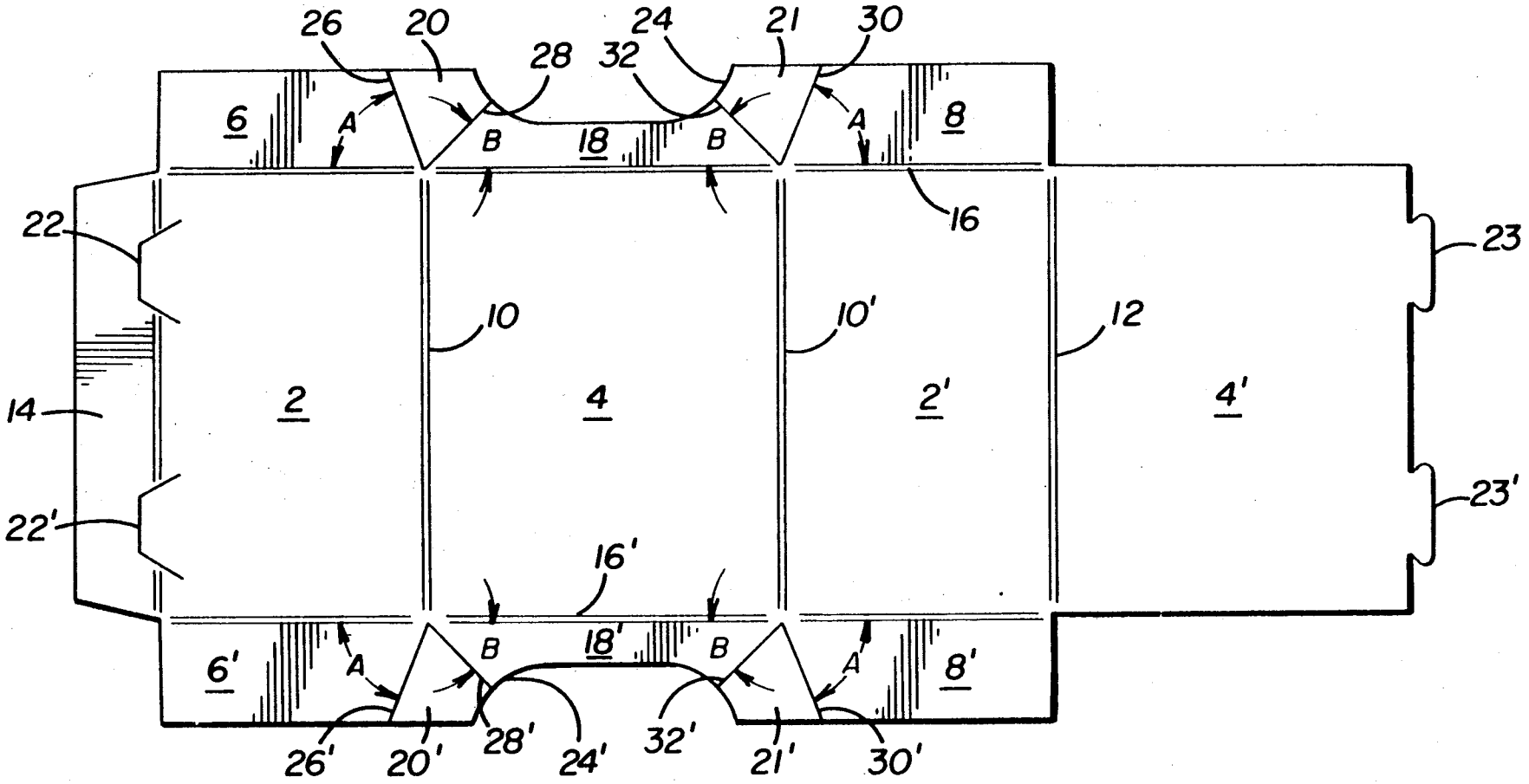
FIG. 1 is a plan view of the instant sheet stock blank configured to form the container of this invention.

With reference to FIG. 1 in the drawings, the construction of the sheet stock blank from which the instant shipping and display container is fabricated may be appreciated. A continuous strip of foldable sheet material, such as cardboard, paper or the like, is cut into discrete, generally rectangular shapes. With the single strike of an appropriate die, the entire configuration shown in FIG. 1 may be cut and formed.

As will be appreciated, the blank is comprised of a rectangularly shaped bottom panel 4 and top panel 4'. These panels are separated from a pair of side panels 2, 2' by means of longitudinally disposed fold lines 10, 10', and 12. The fold lines, all predisposing the sheet material to fold in the same direction (upwardly, toward the viewer of FIG. 1), are applied by the same die which cuts the blank to its basic shape.

The side panels and the bottom panel have extended portions which form the inventive aspects of the present invention. Separated by transverse fold lines 16 and 16' from respective side panels and bottom panel, are side flaps 6, 6', 8, 8' and retainer tabs 18, 18' respectively. The retainer tabs are separated from the side flaps by four side sections 20, 20', 21, 21'. These side sections are formed by oblique fold lines 26, 26', 28, 28', 32, 32', 30, 30'. These oblique fold lines are disposed with respect to transverse fold lines 16, 16' by angles "A" and "B" of less than 90°.

Figure 3:
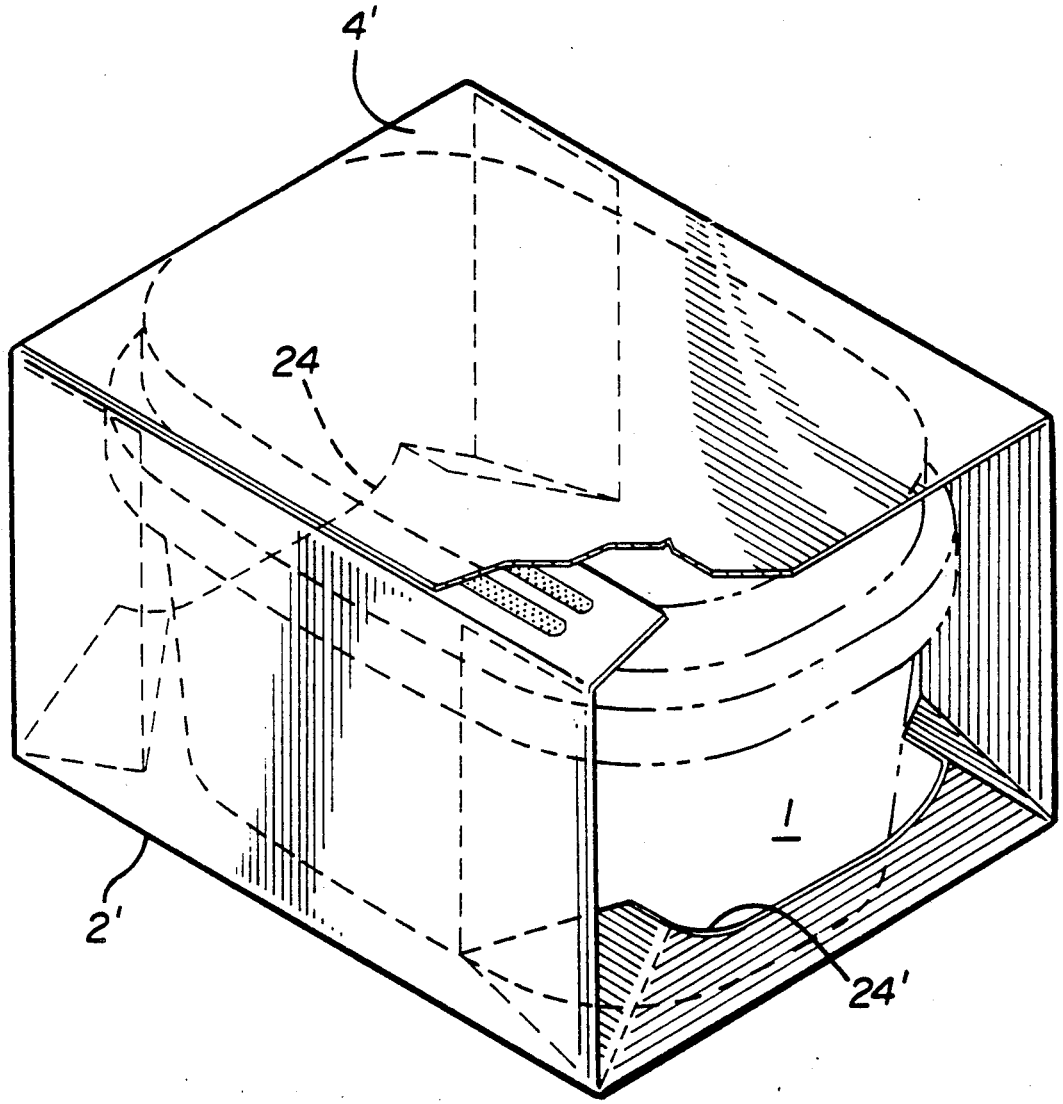
FIG. 3 is an isometric view, partially in section and partially in phantom, of the instant container shown folded and fastened into operative condition retaining a comestible package.
Figure 4:
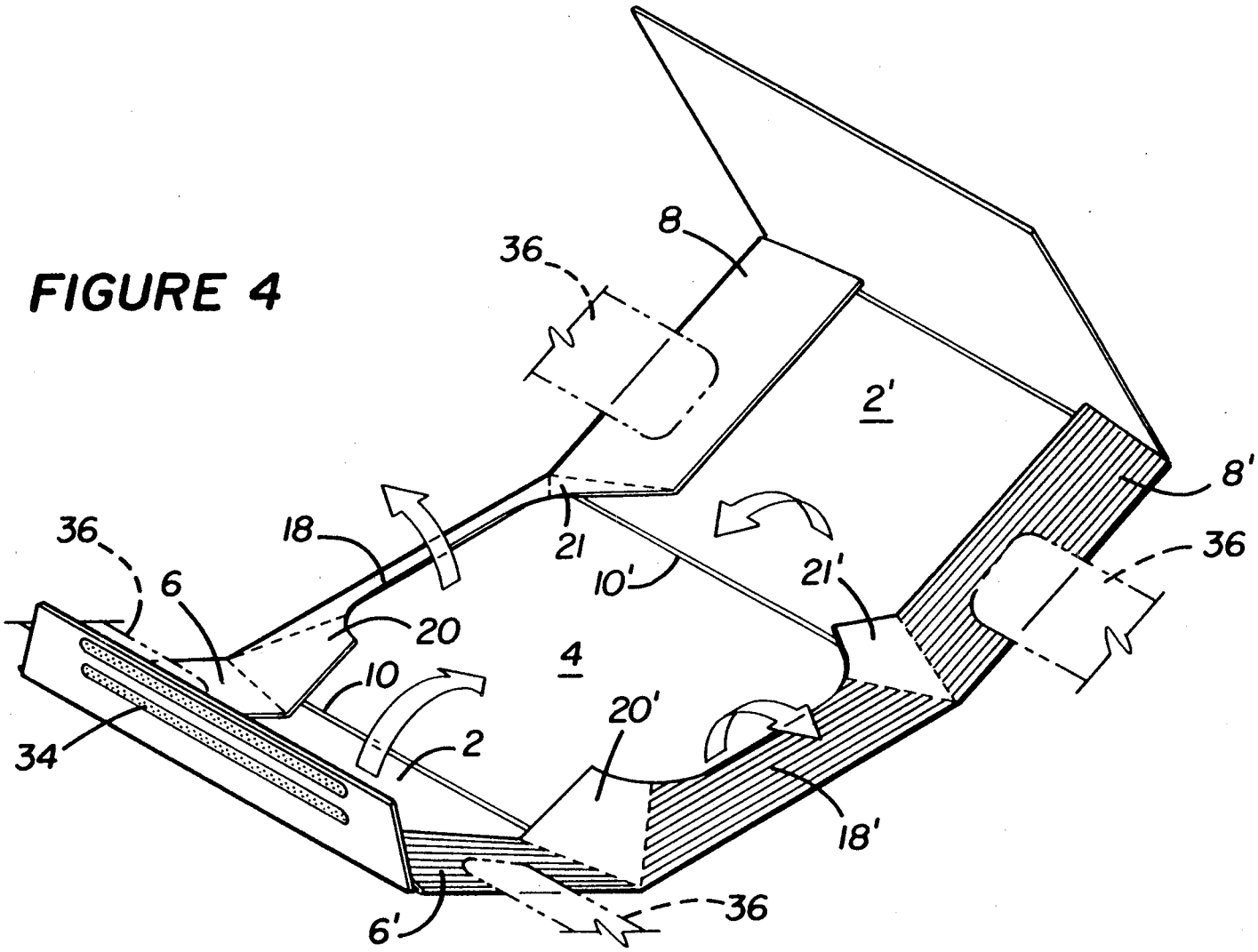
FIG. 4 is an isometric view of the container in a partially folded configuration showing mechanical holding means holding the side flaps fixed with respect to the side panels.

Separated from one of the side panels 2 by the longitudinal fold line 12 is the top panel 4'. The top panel is equipped with a pair of fastener tabs 23, 23'. These tabs are adapted to engage a pair of cooperative fastener slots 22, 22' which are cut into the side panel 2. With reference to FIG. 4, an alternative fastening means, in lieu of the tabs and slots, may be readily appreciated. An adhesive strip, such as hot melt glue or the like is shown at 34 applied to the side panel extension 2. FIG. 3 shows the container in closed configuration, with the strip 34 in adherent engagement with the top panel 4'.

Figure 2:
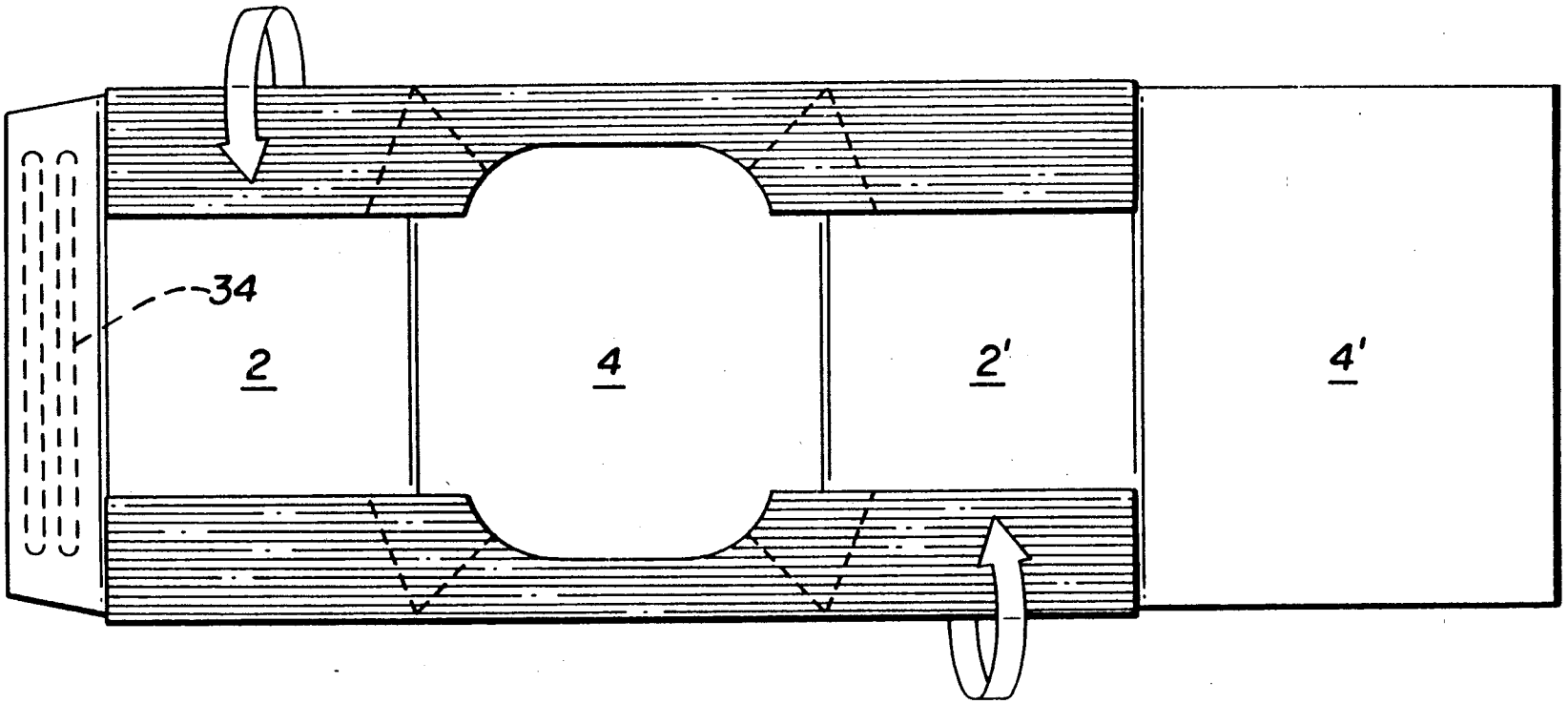
FIG. 2 is a plan view of the container shown after a single fold and holding procedure has fixed the side flaps with respect to each side panel. This figure also shows an alternate form of fastener means.

FIG. 2 shows the sheet blank of the present invention after a single manufacturing process has been employed to prepare it for use as a container. By comparing the blank configuration shown in FIG. 1 with that shown in FIG. 2, it will be readily appreciated that the side flaps 6, 8, 6', 8' have been folded down into contact with the side panels 2, 2'. It may also be noted that the corresponding retainer tabs 18, 18' have been folded flat into contact with the bottom panel 4. In one embodiment, as part of the folding process, adherent medium, such as hot melt glue is applied only between the side flaps 6, 6', 8, 8' and contiguous areas of the side panels. Once the glue on such areas has set, the interior surfaces of the folded side flaps are held against movement with respect to the interior surfaces of the side panels 2, and 2'. In the preferred embodiment, mechanical means, such as elements 36, shown in FIG. 4, or the package 1 itself, are used as holding means in lieu of the adherent medium.

When the container is folded, to the configuration shown in FIG. 3, such holding means will cause the retainer tabs to fully raise. The interior surface material of the container is essentially the same length as the external surface material. Therefore the interior surface material is put under a compressive or "buckling" force when the container is folded into the configurations shown in FIG. 3, and FIG. 4. FIG. 4 shows how such compressive force lifts the retainer tabs 18, 18' as the container is folded along fold lines 10 and 10'. As the side panels 2 and 2' are progressively lifted toward the viewer (as shown in FIG. 4), the side flaps 6, 8, 6', and 8', held in place by the holding means, are forced to compress the side sections 20, 21, 20' and 21'. With continued folding, the side sections and retainer tabs "buckle" upwardly, as shown in FIG. 4, in the direction of the viewer until they reach the three dimensional configuration shown in FIG. 3.

In the configuration shown in FIG. 3, the retainer tabs, especially their cut-out portions 24, 24', fixably engage and retain the comparably shaped comestible package 1, shown in phantom.

The uniform and controlled "raising" of the retainer tabs is directed by the oblique fold lines 26, 28, 30, 32, 26', 28', 30', 32' which are disposed at angles, "A" and "B", of less than 90° with respect to the transverse fold lines 16, 16'.

Thus, the preferred embodiments of the invention have been illustrated and described. It must be clearly understood that the preferred embodiments are capable of variation and modification and are not limited to the precise details set forth. For example, it is apparent that the blank from which the inventive container is made can be any number of different sheet materials and the actual methods for cutting, folding and glueing the side flaps can be varied. Also, the dual fastener tabs and slots can be made unitary or can be replaced by equivalent means. This invention includes all such variations and modifications as fall within the scope of the appended claims.

We claim:

1. A container for retaining and displaying a unitary package comprising; a foldable sheet material blank, said sheet material blank having bottom panel means for engaging a bottom portion of said package and having side panel means and top panel means for engaging side and top portions respectively of said unitary package, said side panel means being defined by and separated from said bottom panel means and said top panel means by a plurality of longitudinal fold lines, said side, top, and bottom panel means also being defined by a plurality of transverse fold lines, retainer tab means extending from said bottom panel means for solely securely retaining said unitary package against longitudinal movement relative to said bottom panel means within said container, said retainer tab means being configured so as to fixedly engage said unitary package of comparable configuration, side flap means extending from said side panel means, said retainer tab means being disposed between said side flap means, holding means for holding said side flap means in folded engagement with said side panel means, said holding means and said retainer tab means being formed for causing said retainer tab means to raise away from said bottom panel means and to incline inwardly upon folding of said sheet material blank along said longitudinal fold lines.

2. The container of claim 1, further including fastener means, said fastener means comprising fastener tab means on said top panel means, said side panel means including fastener slot means for cooperatively engaging said fastener tab means to retain said container in a folded configuration.

3. The container of claim 1, further including fastener means, said fastener means including adherent medium for fastening said top panel means relative to said side panel means.

4. The invention of claim 1, wherein oblique fold lines are provided in said sheet material blank proximate said retainer tab means, said oblique fold lines being disposed for causing said retainer tab means to move away from said bottom panel means to form a raised surface for engaging said package.

5. The invention of claim 4 wherein said oblique fold lines form side section means disposed between said side flap means and said retainer tab means, each of said oblique fold lines being disposed with respect to said transverse fold lines at an angle of less than 90°.

* * * * *